United States Patent [19]

Sostegni

[11] 4,157,645

[45] Jun. 12, 1979

[54] PRODUCTION OF A BOUCLÉ TYPE FANCY YARN

[75] Inventor: Giuliano Sostegni, Sesto Fiorentino, Italy

[73] Assignee: Chenil Cont GS. S.R.L., Italy

[21] Appl. No.: 954,607

[22] Filed: Oct. 25, 1978

[51] Int. Cl.[2] ..... D02G 3/42

[52] U.S. Cl. ..... 57/24

[58] Field of Search ..... 57/24, 3, 12, 58.3, 57/203

[56] References Cited

U.S. PATENT DOCUMENTS

| | | | |
|---|---|---|---|
| 3,357,166 | 12/1967 | McCarthy | 57/24 |
| 3,626,679 | 12/1971 | Schwartz | 57/24 |
| 3,777,464 | 12/1973 | Gross | 57/24 |
| 3,861,128 | 1/1975 | Whitaker | 57/24 |
| 3,868,812 | 3/1975 | Chatin | 57/12 |
| 3,869,850 | 3/1975 | Gross | 57/24 |
| 3,969,881 | 7/1976 | Boldrini | 57/24 |

*Primary Examiner*—John Petrakes

*Attorney, Agent, or Firm*—McGlew and Tuttle

[57] ABSTRACT

A device for the production of a bouclé type fancy yarn comprises two off-center rotating members engaging, via off-center bearings, a central element which remains stationary. The central element carries a triangular tool having a lower extension flanked by two entraining means. An effect yarn is fed by one of the rotating members in order to form turns around the tool and its extension. A first core yarn, which acts as a binding yarn, is fed along the extension to pass within the turns of the effect yarn, while a second core yarn engages the effect yarn turns from the outside.

4 Claims, 7 Drawing Figures

40
36
46
42
F1
30
32
34
E
31
24
28
7
24B
15
3
1
16
5
10
10
9A
9
9B
52
E
56
54
60A

PRODUCTION OF A BOUCLE TYPE FANCY YARN

FIELD OF THE INVENTION

The present invention relates to a device for the production of a bouclé type fancy yarn.

SUMMARY OF THE INVENTION

According to the invention, there is provided in a device for the production of a bouclé type fancy yarn, two off-center rotary members, off-center bearing means carried by the rotary members, a central element mounted by said bearings so that the central element remains stationary, a tool of generally triangular shape with a lower extension, said tool being carried by the central element, yarn entraining means at opposite sides of said lower extension, one of said two rotary members being arranged to feed an effect yarn to the tool whereby turns of said effect yarn are formed around the tool, means for feeding a first core yarn along the tool extension to pass within the turns, and means for feeding a second core yarn on the outside of the turns of the effect yarn, said yarns being twisted at the exit from the entraining means.

BRIEF DESCRIPTION OF THE DRAWINGS

An embodiment of the invention will now be described, by way of example only, with reference to the accompanying diagrammatic drawings, in which.

DESCRIPTION OF THE PREFERRED EMBODIMENTS

Figure 1:
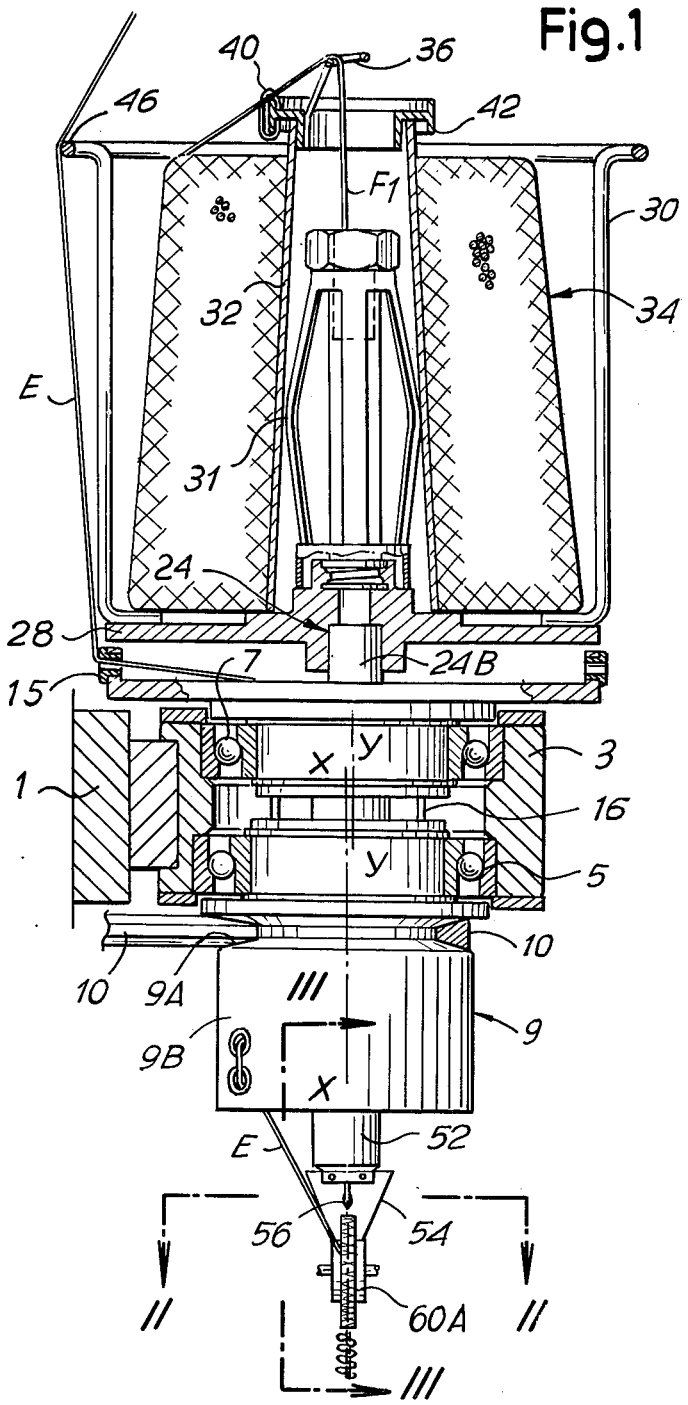
FIG. 1 shows an overall, partly sectioned, side elevation of a device according to the invention.
Figure 5:
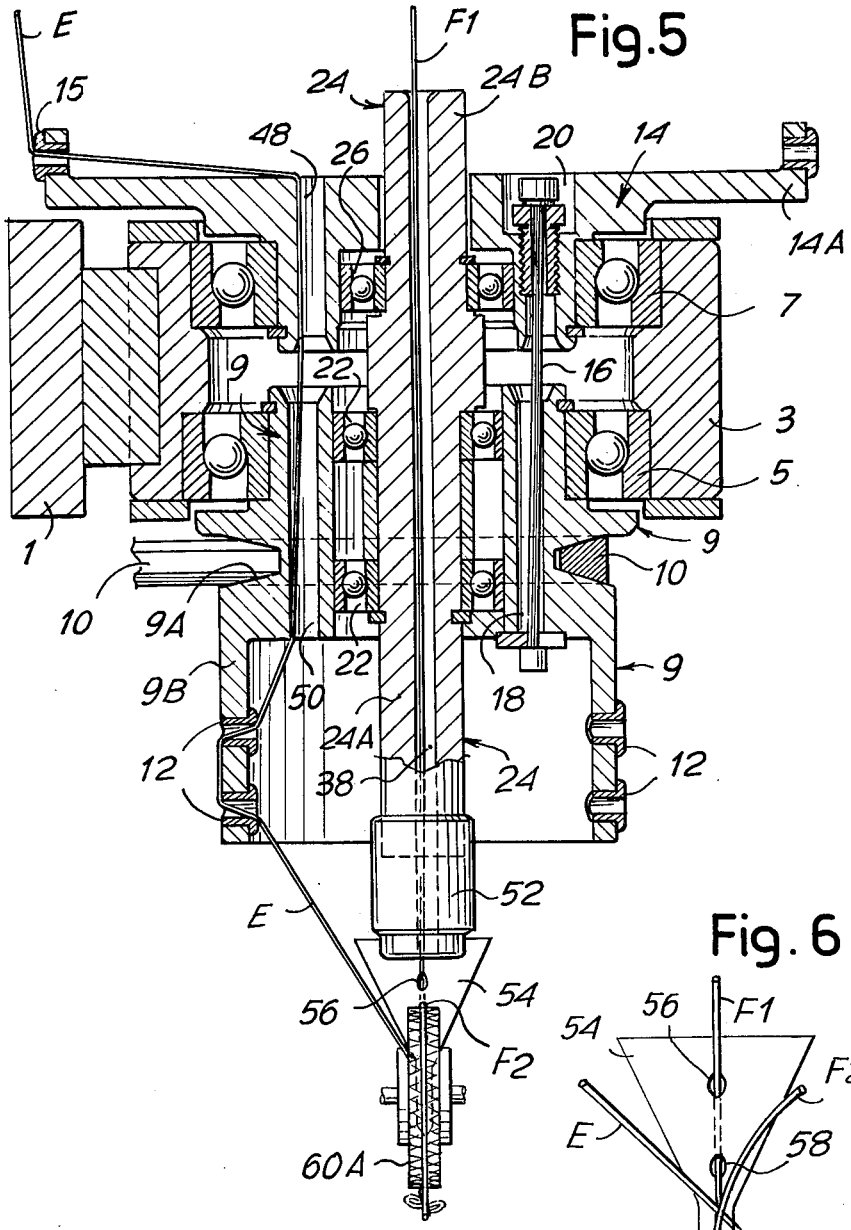
FIG. 5 is a fragmentary longitudinal section, to an enlarged scale, of the device.
Figure 6:
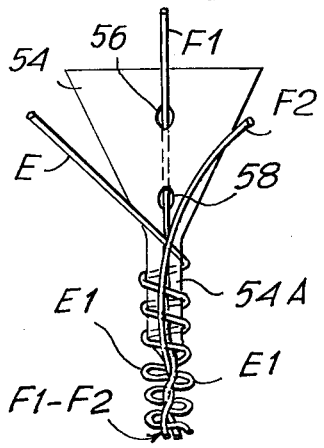
FIG. 6 shows, to an enlarged scale, the lower end portion of a winding tool.

As illustrated in the accompany drawings, on a fixed structure, of which a part 1 is shown, a bushing 3 is mounted with its through-cavity extending vertically. On the inside of this bushing 3 there are upper and lower off-center seats for two bearings which support members which rotate about vertical axes X—X and Y—Y (see FIG. 1). More particularly the lower seat houses a rolling bearing 5 centered on the axis X—X and the upper seat houses a rolling bearing 7 centered on the axis Y—Y. The bearing 5 supports a rotary member 9 which has a groove 9A for a Vee-belt 10 or other suitable means for driving the rotary member 9. At its lower end portion, the member 9 is hollow to form a cup 9B which carries on its side-wall at least one pair of thread guides 12 (see FIG. 5). The bearing 7 supports a rotary member 14 (which is off-center or eccentric with respect to the member 9) and which has in an upper part, a disc 14A provided with at least one thread guide 15 at its periphery (see FIGS. 1 and 5).

The two members 9 and 14 are connected for simultaneous rotation by means of at least one elastic tie rod 16 which extends between a hole 18 in the member 9 and a hole 20 in the member 14. There is a play between the rod 16 and the holes 18 and 20 to enable the rod to bend and to incline so as to permit the relative movement which will occur between the two holes 18 and 20 during the rotation of the members 9 and 14 due to their eccentricity. The rotational drive for the two members is provided by the belt 10.

In the interior of the member 9 concentrically with the bearing 5, there is formed an axial through-seat for bearings 22 centered on the axis X—X to support a portion 24A of a central elongate member 24 extending through the members 9 and 14. A bearing 26 is carried by the member 14, concentrically with the bearing 7. The bearing 26 is centered on the axis Y—Y supports a portion 24B of the central member 24; the two portions 24A and 24B of the member 24 are mutually offset with the same eccentricity as that between the axes X—X and Y—Y. This arrangement ensures that the member 24, while being free from restraint by external fixed parts, is prevented from rotating, this effect being provided by mounting the member 24 about the two offset axes X—X and Y—Y and by means of the bearings 22 and 26. The central member 24 therefore remains stationary.

On the upper part of the central member 24 is arranged a plate 28 which carries a cage 30 and a seat for replaceable spindle 31, which serves to center the core 32 of a bobbin 34. Yarn F1 is unwound from the external surface of the bobbin 34, and is directed by an upper thread guide to pass generally axially through the core 32 and then into an approximately axial hole 38 of the member 24 for the purposes to be described hereinafter. The yarn F1 is engaged by a ring 40 slidable along an annular track 42 carried by the core 32.

The cage 30 carries a ring 46 that serves as peripheral sliding guide for an effect yarn E that comes from a stationary tank through a substantially co-axial supply to the ring 46. From the ring 46 the effect yarn E passes via one of the thread guides 15, into an axial hole 48 in the member 14, thence through a corresponding hole 50 in the member 9 and one of the pairs of thread guides 12, to reach, like the yarn F1, a tool 54 mounted at the lower end 24A of the member 24. The ring 46 and the thread guide 15 cause the effect yarn to be diverted laterally of the bobbin 34.

Figure 2:
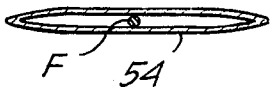
FIGS. 2 and 3 are, respectively a section and a side elevation according to lines II—II and III—III of FIG. 1.

The lower end 24A of the central member 24 carries a tool holder 52 to which the tool 54 is attached. The tool 54 is in the form of a hollow body of generally triangular shape. The yarn F1 passes into the interior of the tool through an upper hole 56 and leaves the tool through a second, lower, hole 58 adjacent to a lower extension 54A of the tool 54. The tool and its extension are of flattened form (see FIGS. 2 and 4).

Figure 4:
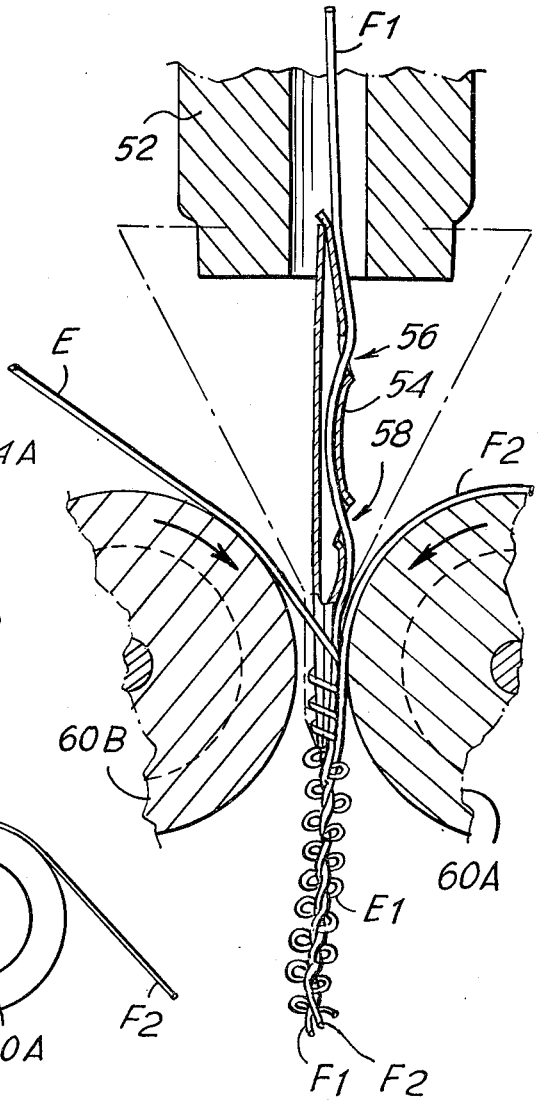
FIG. 4 shows, to an enlarged scale, a detail of FIG. 3.
Figure 3:
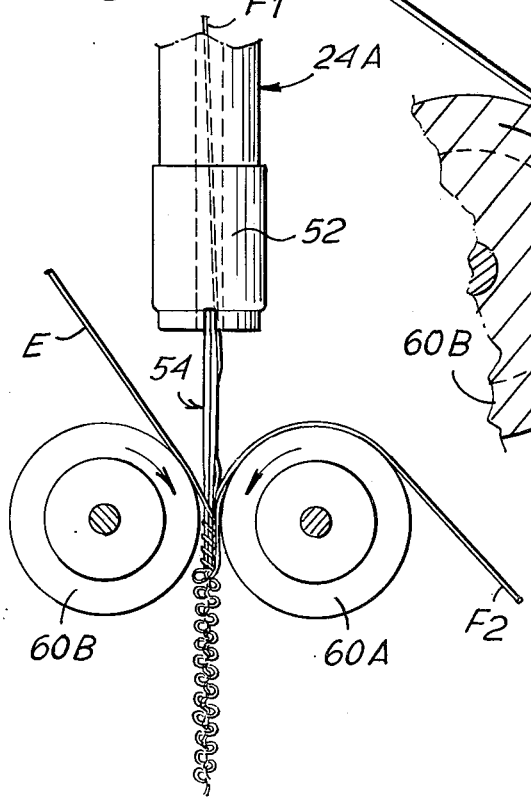

The extension 54A extends between two rollers 60A, 60B, which nearly contact the extension, the rollers having knurled surfaces, and the two rollers being rotated as indicated by the arrows in FIG. 4. The yarn F1 forms a first core yarn of the fancy yarn to be produced, and a second core yarn F2 is fed from a fixed tank to be deflected downwardly over one of the two rollers 60A, 60B, (as shown in the roller 60A). The effect yarn E from the lower thread guide 12 reaches the tool 54 and due to the rotation of the member 9 is wound on the tool 54. The turns of the yarn E advance downwardly and progressively reduce in diameter until they wind around the extension 54A and the core yarn F1 which longitudinally grazes the extension 54A. The turns E1 of the effect yarn E are caused to advance downwardly by the combined action of the two rollers 60A, 60B which rotate as indicated by the arrows. Between these two rollers there are therefore the flattened turns E1 of the effect yarn E wound on the extension 54A, whilst the yarn F1 passes longitudinally on the inside of the turns E1 and the yarn F2 on the outside. The yarn F1 acts as a binding yarn.

As soon as the yarns F1, F2 leave the two rollers 60A, and 60B they are engaged in a known manner by a twisting system, for example the ring type, that causes the twisting of the two core yarns F1, F2 and consequently the engagement of the turns E1 that form bushes of effect yarn stabilized by the twisted cores F1, F2. The yarn is then wound on a substantially co-axial spindle lying under the portion 24A of the central member 24.

By replacing the tool 54 with another tool having a different width of its extension 54A, the lateral size of the bouclé yarn produced can be changed, the width of the extension 54A determining the size of the flattened turns of the effect yarn E; the rollers 60A and 60B will also be replaced in order to correspond to the width of the extension.

The misalignment or offsetting of the bearings 22 and 26 prevents, as already stated, the rotation of the central member 24, but permits completely free rotation around it of the effect yarn E, so that the effect yarn is wound around the tool 54 and its extension 54A.

Figure 7:
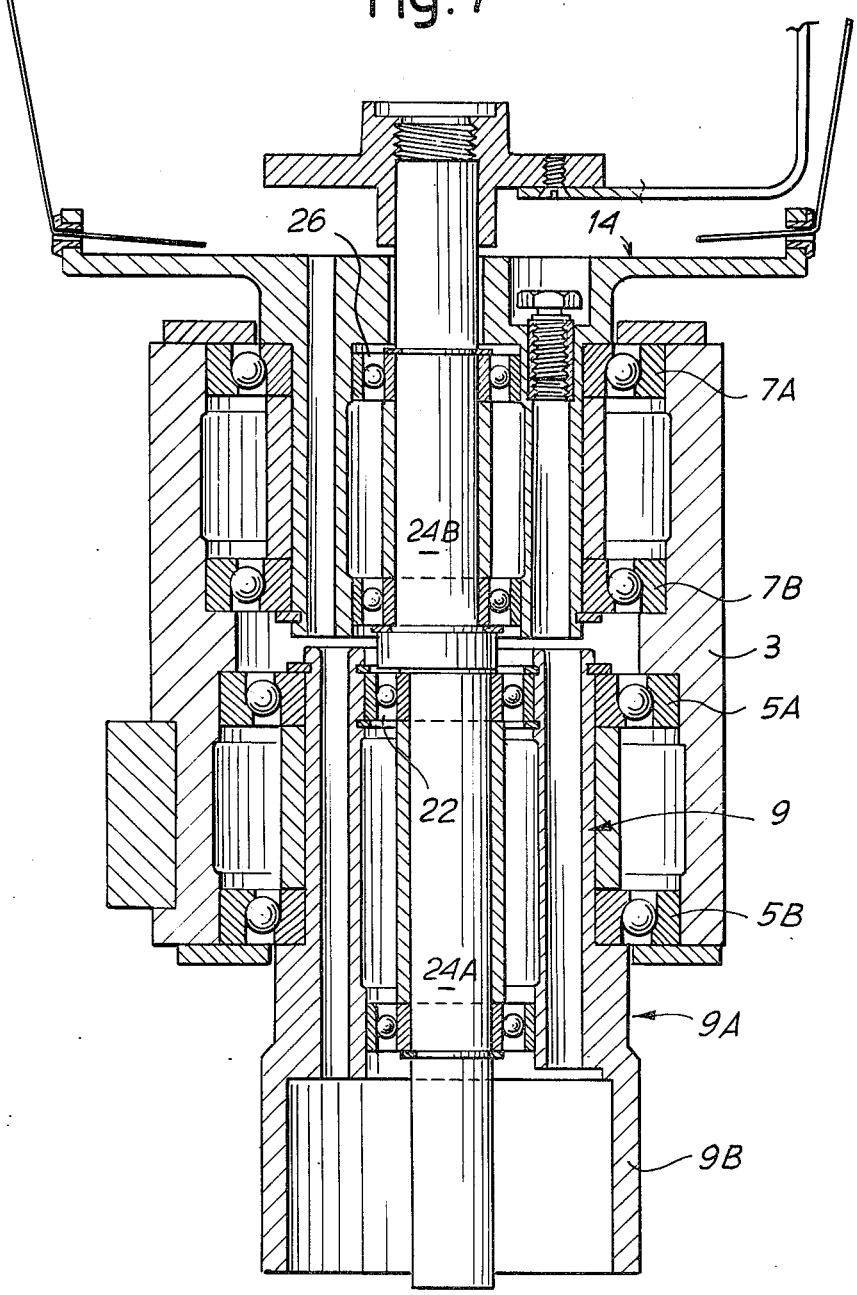
FIG. 7 is a section, similar to FIG. 5, but showing a modified arrangement.

In the modified embodiment of FIG. 7, the members 9 and 14 are mounted on the support 3 by pairs of bearings 5A, 5 and 7A, 7B, instead of single bearings as in the preceding embodiment.

What is claimed is:

1. In a device for the production of a bouclé type fancy yarn, two off-center rotary members, off-center bearing means carried by the rotary members, a central element mounted on said bearings so that the central element remains stationary, a tool of generally triangular shape with a lower extension, said tool being carried by the central element, yarn entraining means at opposite sides of said lower extension, one of said two rotary members being arranged to feed an effect yarn to the tool whereby turns of said effect yarn are formed around the tool, means for feeding a first core yarn along the tool extension to pass within the turns, and means for feeding a second core yarn on the outside of the turns of the effect yarn, said yarns being twisted at the exit from the entraining means.

2. A device according to claim 1, further comprising flexible, movable, rod means connecting the two off-center members for simultaneous rotation, means defining longitudinal holes in the two members for the passage of the effect yarn, and means defining a lateral thread guide rotatable around a path surrounding the tool axis.

3. A device according to claim 1, further comprising a bobbin for the first core yarn, said bobbin being carried by the central element, and means defining yarn guides for directing the effect yarn laterally of the bobbin.

4. A device according to claim 1, wherein the tool is hollow and has means defining inlet and outlet apertures for the first core yarn which passes between the apertures through the interior of the tool, the outlet aperture being adjacent the extension.

* * * * *